US007633244B2

(12) United States Patent
Cheng

(10) Patent No.: US 7,633,244 B2
(45) Date of Patent: Dec. 15, 2009

(54) METHOD FOR DIMMING MULTIPLE LAMPS

(75) Inventor: Ying-Chang Cheng, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 93 days.

(21) Appl. No.: 11/902,143

(22) Filed: Sep. 19, 2007

(65) Prior Publication Data

US 2009/0072759 A1 Mar. 19, 2009

(51) Int. Cl.
*H05B 41/36* (2006.01)

(52) U.S. Cl. ..... 315/291; 315/177; 315/209 R; 315/307

(58) Field of Classification Search ..... 315/119, 315/177, 185 R, 186, 189, 193, 209 R, 291, 315/294, 295, 297, 299, 300, 301, 302, 306, 315/307, 308, 312, 313, 317, 320, 324, 362, 315/DIG. 4

See application file for complete search history.

(56) References Cited

U.S. PATENT DOCUMENTS 6,369,704 B2 * 4/2002 Hilleary ..... 340/458
7,081,720 B2 * 7/2006 Burau et al. ..... 315/291

* cited by examiner

*Primary Examiner*—Douglas W Owens
*Assistant Examiner*—Jianzi Chen
(74) *Attorney, Agent, or Firm*—Muncy, Geissler, Olds & Lowe, PLLC

(57) ABSTRACT

A method for dimming multiple lamps includes: getting a brightness range of a lighting area which has at least two light sources, getting a dimming range of the light sources, setting the brightness of the lighting area, determining the dimming value of each light source, and defining different dimming values of at least two light sources. The luminosity adjustment upper limit and lower limit of the individual light sources are obtained. After the brightness of the lighting area is set the dimming value of each light source is determined to form the brightness of the lighting area through the two light sources of different brightness.

17 Claims, 5 Drawing Sheets

METHOD FOR DIMMING MULTIPLE LAMPS

FIELD OF THE INVENTION

The present invention relates to a method for dimming multiple lamps and particularly to a method to control and adjust the luminosity of a plurality of light sources.

BACKGROUND OF THE INVENTION

A conventional liquid crystal display (LCD) requires a backlight module to serve as the light source. The backlight module generally includes a plurality of lamp modules each consists of a plurality of cold cathode fluorescent lamps (CCFLs). The number of the lamp modules may increase or decrease depending on the size of the LCD. The conventional lamp activating circuit includes a pulse modulation unit to generate a duty cycle signal to control operation of a power switch unit, then to regulate the tube current flowing through the lamp module, thereby to adjust the luminosity of the CCFLs. While the conventional backlight module changes the luminosity of the lamp by altering the tube current through regulation of the duty cycle of the power switch, to dim the light has to reduce the tube current. But the tube current has a lower limit while the CCFL is functioning. If the tube current drops below the lower limit two ends of the CCFL will have uneven brightness. This uneven brightness becomes more serious as the tube current drops even more. Hence there is a limited range to adjust the luminosity by regulating the tube current. In some special applications (such as sailing on the sea or camping outdoors at night) too much brightness is not desirable. Hence there is a need to provide an improved method to extend the dimming range downwards so that the products used the lamp module can be adjusted to a lower luminosity to suit the special environments.

SUMMARY OF THE INVENTION

In view of the problems occurred to the conventional technique that have a lower limit to adjust the luminosity of a light source and a luminosity adjustment range not meeting the requirement of special environments, the primary object of the present invention is to provide a circuit structure to expand the luminosity adjustment range of the light source.

The present invention provides a method for dimming multiple lamps. The method includes: getting a brightness range of a lighting area which has at least two light sources, getting a dimming range of the light sources, setting the brightness of the lighting area, determining the dimming value of each light source, and defining different dimming values of at least two light sources. A luminosity adjustment upper limit and a luminosity adjustment lower limit of the individual light sources are obtained. After the brightness of the lighting area is set, the dimming value of each light source is determined to form the brightness of the lighting area through the two light sources of different brightness. A circuit is provided to implement the method, which includes: a dimming signal source, a duty voltage regulation unit and a switch unit coupled in parallel with the duty voltage regulation unit. The dimming signal source generates a dimming signal proportional to the dimming range of the light source. The duty voltage regulation unit receives the dimming signal and outputs a voltage regulation signal to a plurality of power transformation units which receive electric power from a power source. The voltage regulation signal controls the amount of power output from the power transformation units to the light sources. The switch unit is connected to the dimming signal source and sets a different cutoff voltage value for each power transformation unit. The voltage of the dimming signal and the cutoff voltage are compared. When the voltage of the dimming signal is lower than one cutoff voltage a corresponding power transformation unit is turned off. Thus the dimming signal regulates the amount of power output to the light source and at the same time also controls asynchronous ON/OFF of the power transformation units. Through the sum of multiple light sources the brightness of the lighting area can be set.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
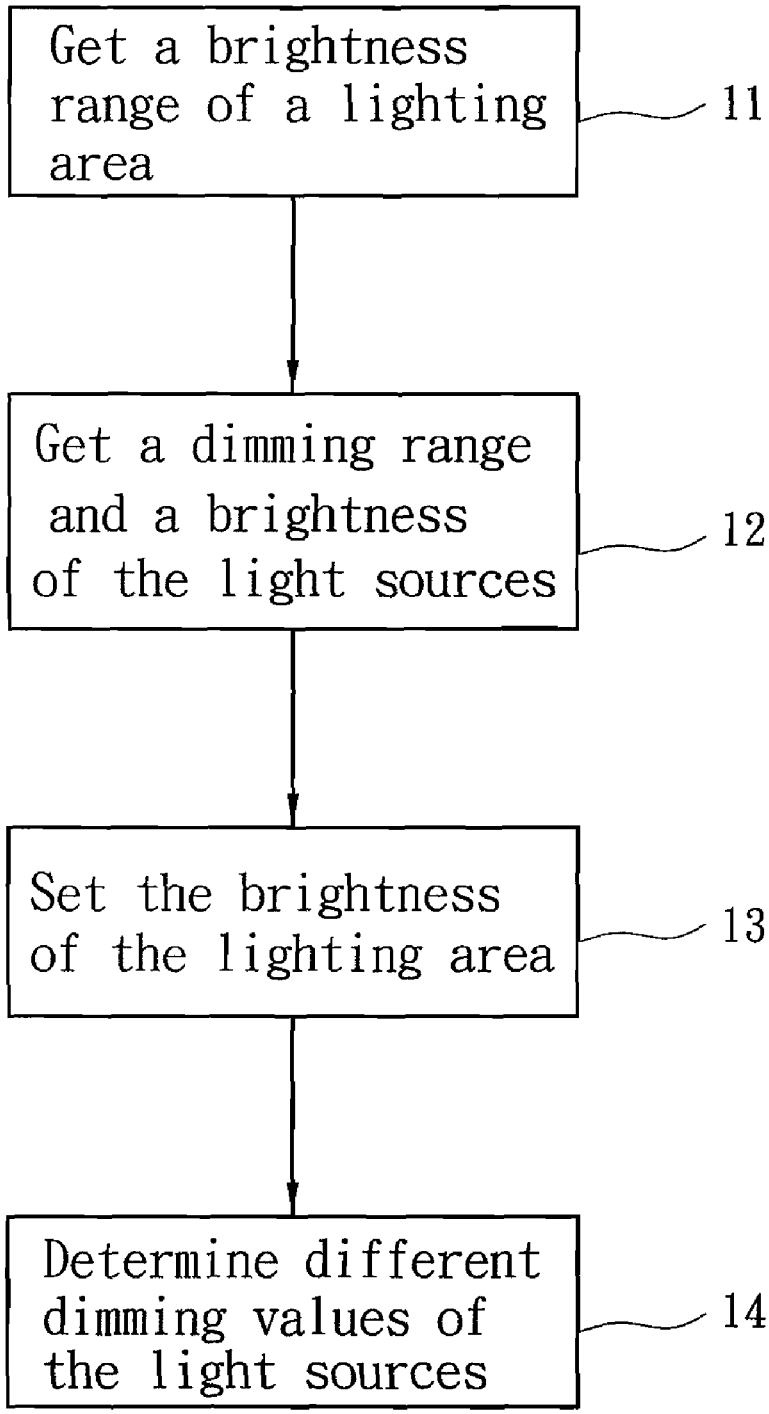
FIG. 1 is a flowchart-1 of the invention.
Figure 2:
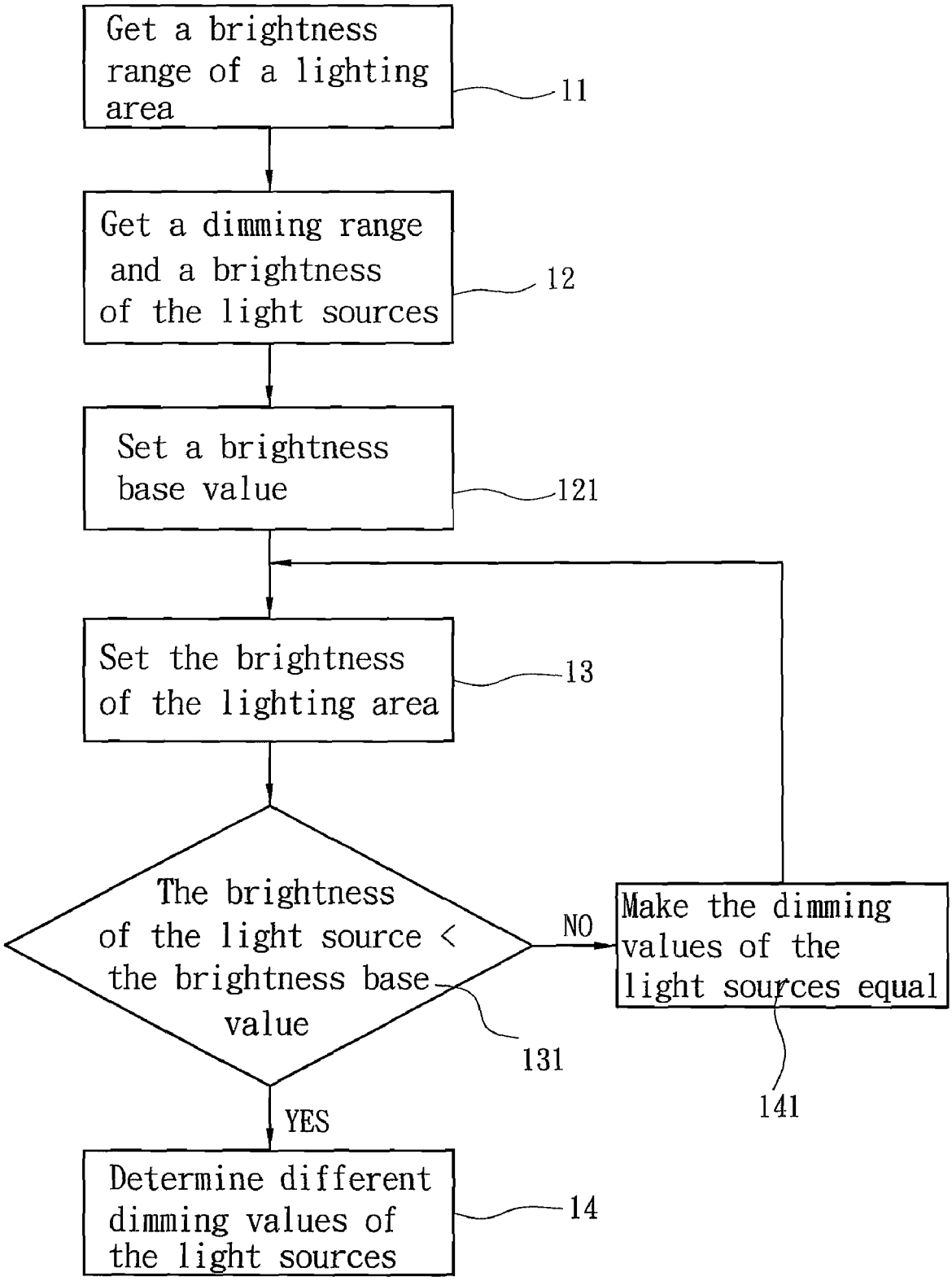
FIG. 2 is a flowchart-2 of the invention.

The present invention provides a method for dimming multiple lamps and aims to control the brightness of a lighting area which has at least two light sources. The method includes steps A through D as follow: A. getting a brightness range of a lighting area; B. getting a dimming range and brightness of the light sources; C. setting the brightness of the lighting area; and D. determining the dimming value of each light source. Refer to FIG. 1 for the flow chart of the method. first, get a brightness range of a lighting area which has at least two light sources to emit light (11); get the brightness of the light sources (12); get the brightness, and a luminosity adjustment upper limit and a luminosity adjustment lower limit to determine the dimming range of each light source, and determine the brightness of the lighting area (13); and determine different dimming values of the light sources based on the brightness of the lighting area (14). By defining the upper and lower limits of the brightness of the lighting area the brightness of the light sources in the lighting area can be obtained. By setting a desired brightness emitted from the lighting area the sum and target of the brightness of the lighting sources can be provided to determine different dimming values of the light sources (14). Each light source has a different dimming value to generate a different brightness. One of the dimming values of each light source may be 0, namely one or more of the light source may be turned off while adjusting the brightness of the light sources to adjust the total brightness of the light sources to make the lighting area to emit a set brightness. The step D may be preceded by a step of determining the brightness that presets a brightness base value. At step C, in the event that the brightness of a set lighting area is greater than or equal to the brightness base value, then the dimming value of each light source is equal. In the event that the brightness at step C is lower than the brightness base value, proceed step D as shown in FIG. 2. At step C, before setting the brightness of the lighting area (13), preset a brightness base value (121), then through step C, after getting the brightness of the lighting area determine whether the brightness of the light source at that moment is smaller than the brightness base value (131); if the brightness of the light source is not smaller than the brightness base value, make the dimming value of each light source equal (141), namely regulate synchronously the dimming value of each light source so that the brightness total of the light sources is obtained to make the lighting area to emit a set brightness, and start anew the step C to set the brightness of the lighting area (13). If the brightness of the light source is smaller than the brightness base value, proceed step D to determine the different dimming value of each light source (14) and make each light source to generate different brightness through different dimming value, and make the brightness total of the light sources to emit the set brightness in the lighting area.

Figure 3:
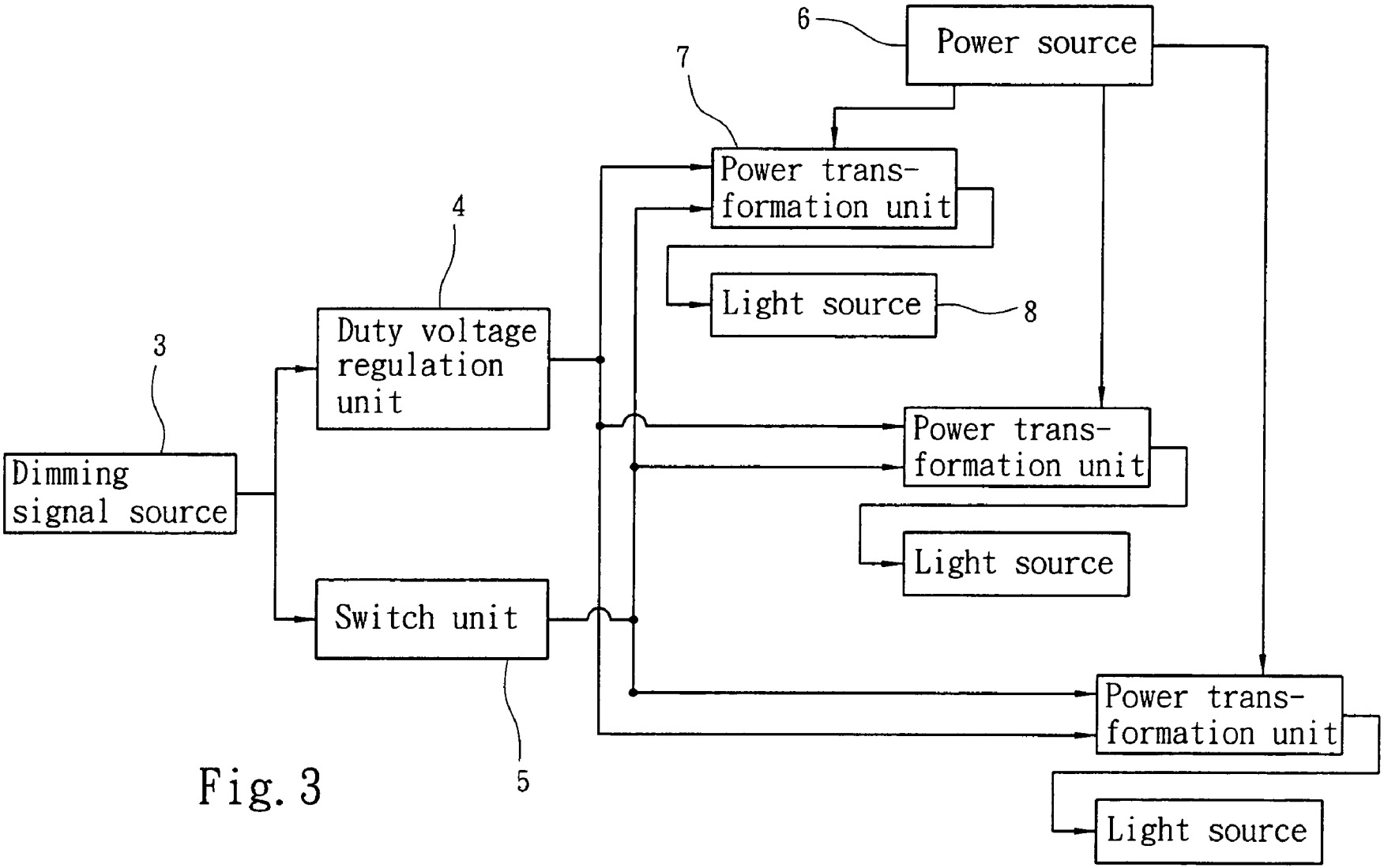
FIG. 3 is a circuit block diagram-1 of an embodiment of the invention.
Figure 4:
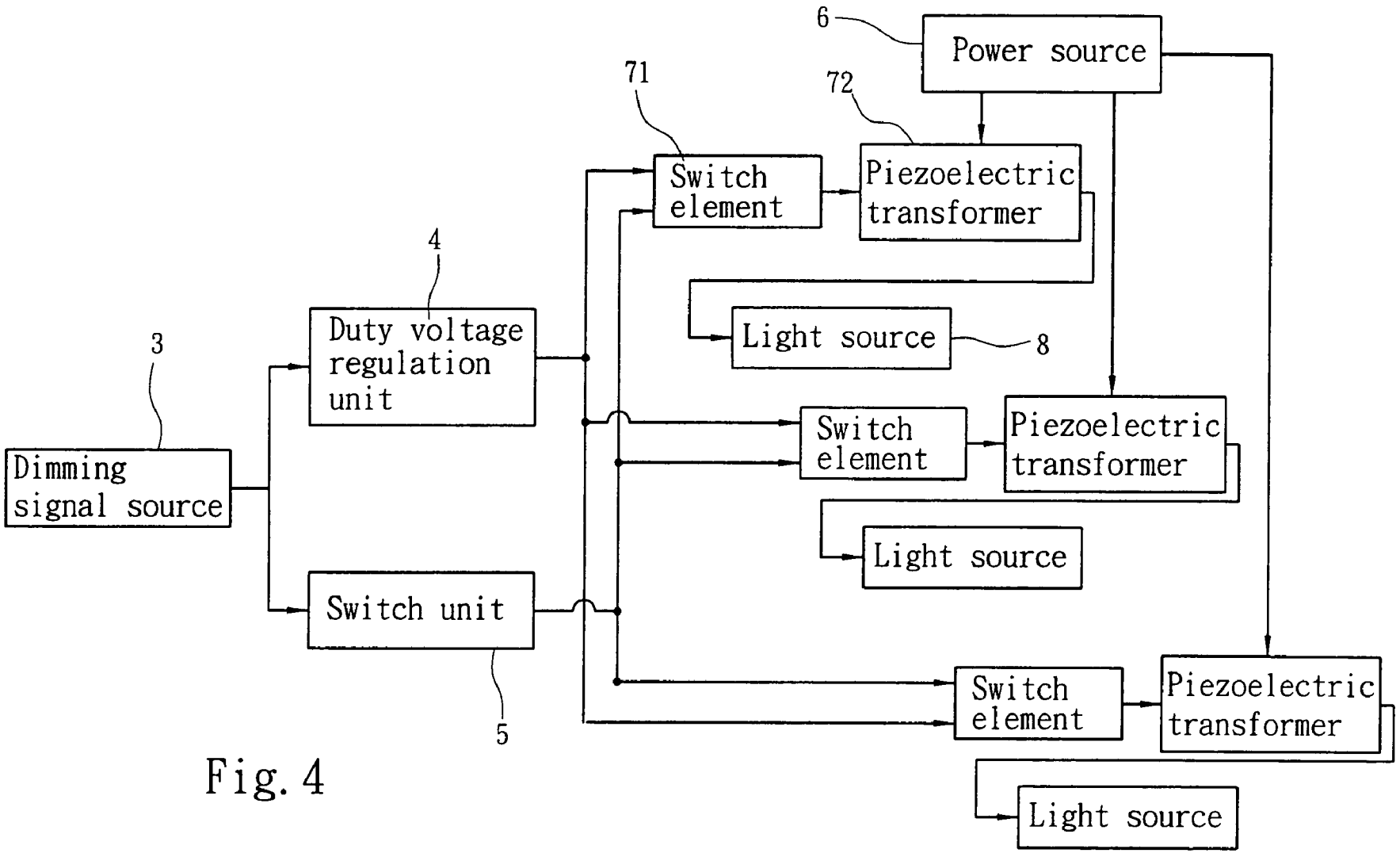
FIG. 4 is a circuit block diagram-2 of an embodiment of the invention.
Figure 5:
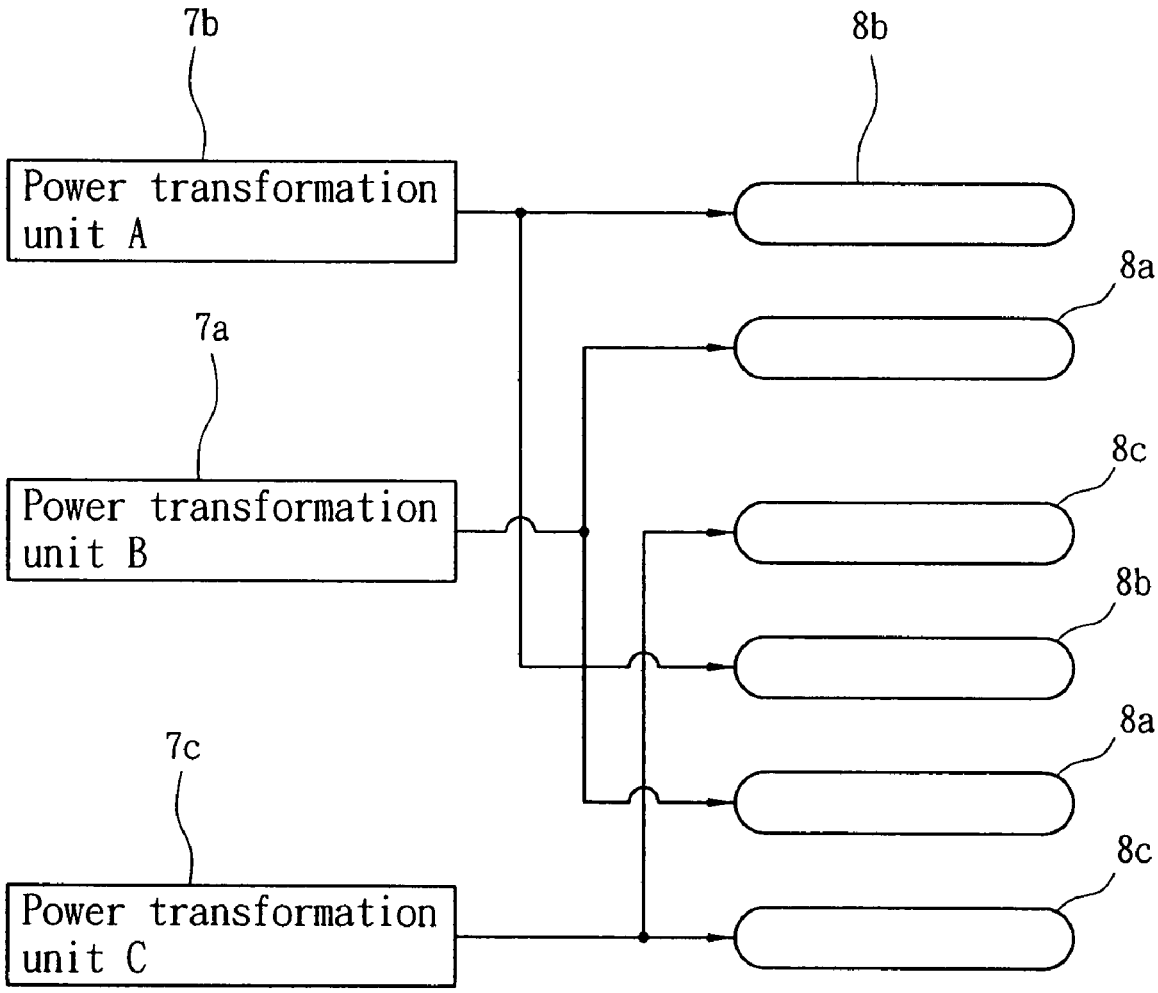
FIG. 5 is a block diagram of another embodiment of the invention.

Refer to FIG. 3 for a circuit structure to implement the dimming method of the invention. It includes a dimming signal source 3, a duty voltage regulation unit 4, a switch unit 5, a power source 6, a plurality of power transformation units 7 and at least two light sources 8. The dimming signal source 3 generates a dimming signal proportional to a dimming range of the light sources 8. The duty voltage regulation unit 4 receives the dimming signal and outputs a voltage regulation signal to the power transformation units 7 which receive power from the power source 6. Through the voltage regulation signal the amount of power output from the power transformation units to the light sources 8 is controlled, thereby to regulate the proportion of the light sources 8. The switch unit 5 is connected to the dimming signal source 3 and the power transformation units 7, and coupled in parallel with the duty voltage regulation unit 4 to set a different cutoff voltage value for each power transformation unit 7. After the switch unit 5 has received the dimming signal, the voltage of the dimming signal is compared with the cutoff voltage values. In the event that the dimming signal is lower than one of the cutoff voltage values the switch 5 generates a cutoff signal to turn off the power transformation unit 7 corresponding to the cutoff voltage value so that while the dimming signal regulates the duty power of the light sources 8 it also controls asynchronous ON/OFF of the power transformation units 7. The power transformation unit 7 may include a switch element 71 and a piezoelectric transformer 72 that connect to each other (referring to FIG. 4). The switch element 71 has a switch position to set current ON or OFF to be input to the piezoelectric transformer 72. By changing the switch position of the switch element 71 the current passing through the piezoelectric transformer 72 can be controlled, thereby to control the power output from the piezoelectric transformer 72 to the light source 8. Thus the duty voltage regulation unit 4 receives the dimming signal to control conduction cycle of the switch element 71 through the voltage regulation signal, while the switch unit 5 sets the cutoff voltage value of each switch element 71. In the event that the dimming signal is lower than one cutoff voltage value the cutoff signal turns OFF the switch element 71 corresponding to the cutoff voltage value so that the light source 8 at the rear end of the switch element 71 is turned OFF beforehand. By setting the light sources 8 ON/OFF asynchronously the brightness of the lighting area can be set. The duty voltage regulation unit 4 is a pulse width modulation circuit. The switch unit 5 includes a plurality of voltage sources and a plurality of comparison circuits connecting respectively to the voltage sources that compare the voltage of the dimming signal with the voltage of the voltage sources, then through output ends of the comparison circuits ON/OFF of the power transformation units 7 can be controlled Refer to FIG. 5 for the block diagram of another embodiment of the invention. It has a first power transformation unit A 7*a*, a second power transformation unit B 7*b*, and a third power transformation unit C 7*c* that are connected respectively to six light sources 8*a*, 8*b* and 8*c*. The first power transformation unit A 7*a*, second power transformation unit B 7*b*, and third power transformation unit C 7*c* output respectively a duty power to the light sources 8*a*, 8*b* and 8*c*. The light sources 8*a*, 8*b* and 8*c* generate brightness in a lighting area that has a relationship with the ON/OFF timing as shown in Table 1 below:

TABLE 1

| | Dimming ratio of Each power transformation unit | | |
|---|---|---|---|
| Dimming Ratio of each Lighting area | Power transformation unit A | Power transformation unit B | Power transformation unit C |
| 100% | ON 100% | ON 100% | ON 100% |
| 75% | ON 75% | ON 75% | ON 75% |
| 50% | ON 50% | ON 50% | ON 50% |
| 35% | ON 50% | OFF 0% | ON 50% |
| 20% | ON 50% | OFF 0% | OFF 0% |

Table 1 shows that due to the lighting sources 8*a*, 8*b* and 8*c* have a luminosity adjustment lower limit because of their operation condition restriction, their luminosity adjustment lower limit is set to 50%. The switch unit 5 also sets the cutoff voltage value of each power transformation unit 7 below the adjustment lower limit. Hence when the dimming signal is adjusted output power of the power transformation units A 7*a*, B 7*b* and C 7*c* also are regulated synchronously to adjust simultaneously the brightness of the light sources 8*a*, 8*b* and 8*c*. When the light sources 8*a*, 8*b* and 8*c* have reached the luminosity adjustment lower limit, and the dimming signal is adjusted further downwards; if the dimming signal is lower than the cutoff voltage value of each power transformation unit 7, the power transformation units A 7*a*, B 7*b* and C 7*c* and their corresponding light sources 8*a*, 8*b* and 8*c* are turned off sequentially so that the effective dimming range of the lighting area can reach 35% or 20% of the maximum luminosity. Another more complicated embodiment is shown in Table 2 below:

TABLE 2

| | Dimming ratio of Each power transformation unit | | |
|---|---|---|---|
| Dimming Ratio of each Lighting area | Power transformation unit A | Power transformation unit A | Power transformation unit A |
| 100% | ON 100% | ON 100% | ON 100% |
| 80% | ON 80% | ON 80% | ON 80% |
| 60% | ON 60% | ON 60% | ON 60% |
| 40% | ON 60% | OFF 0% | ON 60% |
| 20% | ON 50% | OFF 0% | OFF 0% |

The embodiment shown in Table 2 is based on a set brightness base value. When the brightness of the lighting area is greater than or equal to the brightness base value, the dimming values of the lighting sources 8*a*, 8*b* and 8*c* are set equal, namely the dimming value of each power transformation unit 7 is adjusted simultaneously. When the brightness of the lighting area is smaller than the brightness base value (the embodiment shown in Table 2 sets the brightness base value at 60% of the dimming ratio of each light source 8), then the dimming values of the light sources 8*a*, 8*b* and 8*c* and the ON/OFF sequences thereof are adjusted asynchronously. Therefore the effective dimming range of the lighting area can be extended.

The embodiments set forth above serve only for illustrative purpose, and are not the limitation of the invention. The brightness of the light sources 8 can be equal to or greater than the luminosity adjustment lower limit. The light source 8 connected to the power transformation unit 7 may be a single or multiple light emitting diode, hot cathode lamp, CCFL or gas discharge lamp. Thus modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method for dimming multiple lamps, comprising the steps of:

A. getting a brightness range of a lighting area which has at least two light sources to emit light;

B. getting a dimming range and a brightness of the light sources, and a luminosity adjustment upper limit and a luminosity adjustment lower limit to determine the dimming range;

C. setting the brightness of the lighting area; and

D. determining a dimming value of each light source and defining different dimming values for the light sources;

wherein the step D is preceded by a step of determining the brightness that sets a brightness base value, at step C when the brightness being greater than or equal to the brightness base value the dimming values of the light sources are equal; when the brightness being smaller than the brightness base value proceed step D.

2. The method of claim 1, wherein the brightness base value of the light sources is equal to the luminosity adjustment lower limit.

3. The method of claim 1, wherein the brightness base value of the light sources is greater than luminosity adjustment lower limit.

4. The method of claim 1, wherein one of the dimming values at step D is 0.

5. The method of claim 1, wherein the light sources are a single lamp.

6. The method of claim 1, wherein the light sources are a plurality of lamps.

7. The method of claim 1, wherein the light sources are a single light emitting diode.

8. The method of claim 1, wherein the light sources are a plurality of light emitting diodes.

9. The method of claim 1, wherein the light sources have a same dimming range.

10. A method for dimming multiple lamps, comprising the steps of:

A. getting a brightness range of a lighting area which has at least two light sources to emit light;

B. getting a dimming range and a brightness of the light sources, and a luminosity adjustment upper limit and a luminosity adjustment lower limit to determine the dimming range;

C. setting the brightness of the lighting area; and

D. determining a dimming value of each light source and defining different dimming values for the light sources;

further having a circuit to implement the method, the circuit including:

a dimming signal source to generate a dimming signal proportional to the dimming range of the light sources;

a duty voltage regulation unit which receives the dimming signal and outputs a voltage regulation signal to a plurality of power transformation units which receive electric power from a power source, the voltage regulation signal controlling the amount of power output from the power transformation units to the light sources; and a switch unit which is connected to the duty voltage regulation unit in a parallel fashion and also connected to the dimming signal source and the power transformation units, and sets a different cutoff voltage value for each power transformation unit;

wherein the voltage of the dimming signal and the cutoff voltage value are compared such that when the dimming signal is lower than the cutoff voltage value, a cutoff signal is generated to turn off one corresponding power transformation unit so that the dimming signal adjusts the amount of power output to the light sources and controls asynchronous ON/OFF of the power transformation units.

11. The method of claim 10, wherein one of the dimming values at step D is 0.

12. The method of claim 10, wherein each power transformation unit includes a piezoelectric transformer and a switch element connecting to each other.

13. The method of claim 12, wherein the switch element has a switch position to set ON or OFF of current input to the piezoelectric transformer.

14. The method of claim 13, wherein the duty voltage regulation unit generates a voltage regulation signal to control ON cycle of the switch element.

15. The method of claim 14, wherein the duty voltage regulation unit is a pulse width modulation circuit.

16. The method of claim 14, wherein the switch element is turned off by the cutoff signal generated by the switch unit when the dimming signal is lower than the cutoff voltage.

17. The method of claim 10, wherein the switch unit includes a plurality of voltage sources and a plurality of comparison circuits connecting to the voltage sources, the voltage of the dimming signal passing through the comparison circuits being compared with the voltages of the voltage sources, the comparison circuits having output ends to control ON/OFF of the power transformation units.

* * * * *